United States Patent [19]

McLellan et al.

[11] Patent Number: 4,576,080

[45] Date of Patent: Mar. 18, 1986

[54] GUITARS

[75] Inventors: William S. McLellan; Alan G. Marriott, both of London, United Kingdom

[73] Assignee: Marriott McLellan Limited, London, England

[21] Appl. No.: 598,343

[22] PCT Filed: Jul. 16, 1982

[86] PCT No.: PCT/GB82/00215

§ 371 Date: Mar. 12, 1984

§ 102(e) Date: Mar. 12, 1984

[87] PCT Pub. No.: WO84/00433

PCT Pub. Date: Feb. 2, 1984

[51] Int. Cl.[4] ..... G10D 1/08

[52] U.S. Cl. ..... 84/267; 84/297 R; 84/304

[58] Field of Search ..... D17/14, 19–21; 84/1.16, 263, 267, 291, 293, 297–299, 304–306, 312 R, 313

[56] References Cited

U.S. PATENT DOCUMENTS

| | | | |
|---|---|---|---|
| 546,374 | 9/1895 | Babbitt | 84/263 |
| 2,216,601 | 10/1940 | Nelson | 84/297 R |
| 2,523,963 | 9/1950 | Mitchell | 84/267 |
| 3,539,699 | 11/1970 | Johnson | 84/1.16 |
| 3,769,871 | 11/1973 | Cawthorn | 84/291 |

*Primary Examiner*—Lawrence R. Franklin

*Attorney, Agent, or Firm*—William R. Hinds

[57] ABSTRACT

An electric guitar comprising a body (1) in which the strings (11) are tuned by means of adjustment keys or knobs (4) located along one side edge of the guitar body (1). The knobs (4) adjust tuning machines (3) located at the rear of the body to which the strings are guided from the front over guide pulleys (5) mounted in the base edge of the body.

10 Claims, 8 Drawing Figures

GUITARS

TECHNICAL FIELD

The invention relates to guitars, particularly electric guitars, and has for its object the provision of a guitar having tuning machines arranged in a novel manner which not only facilitates tuning but also enables the guitar to be compact and of a striking modern design.

BACKGROUND ART

It is known, e.g. from U.S. Pat. Nos. 4,241,637 and 4,192,213, to provide the tuning machines of a guitar on the guitar body as opposed to their usual location on the guitar head. Such an arrangement facilitates tuning and reduces the overall length of the instrument.

The present invention enables the length of a guitar to be reduced still further and also enables a guitar to be more easily and more conveniently tuned.

DISCLOSURE OF THE INVENTION

According to the present invention there is provided a guitar comprising a head, a body, means for anchoring one end of each of a plurality of strings to the head, and a plurality of tuning machines mounted on the body for retaining the non-anchored end of a string, characterised in that each tuning machine is located on the back of the body and that the arrangement of the guitar is such that, when strung, the strings pass from the front to the back of the body about the bottom edge thereof.

For convenience in tuning, knobs or keys associated with the tuning machines (and by adjustment of which the strings can be tuned) are located along one side of the guitar body, advantageously on that side of the body which is uppermost when the guitar is held in the playing position.

Conveniently the strings are guided from the front to the back of the body by guide means located at or towards the base edge of the body. The guide means preferably comprises a number of pulleys, one for each string, each freely rotatable optionally on a common shaft which may be mounted in a slot formed in the base edge of the body.

In order to reduce frictional forces on the strings during tuning, the guitar may include a bridge, conventionally located on the front of the body adjacent to the guide means and comprising a plurality of freely rotatable rollers across which the strings pass.

In one preferred embodiment of the invention to be described, the tuning machines are spaced along one side of the body adjacent to the knobs or keys therefor, the rear of the body having secondary guides, and the strings pass from said guide means over the secondary guides from which they each extend at an angle towards a respective tuning machine. The secondary guides, which conveniently comprise freely rotatable pulley or rollers, are preferably spaced substantially equidistant from the guide means and the strings extend in a diverging or fanned manner towards the tuning machines.

In another preferred embodiment, the strings extend between the guide means and the tuning machine in a direction substantially parallel to their path along the front of the body, the positions of the tuning machines being staggered at progressively increasing distances both from the guide means and from one side edge.

BEST METHOD FOR CARRYING OUT THE INVENTION

Figure 1:
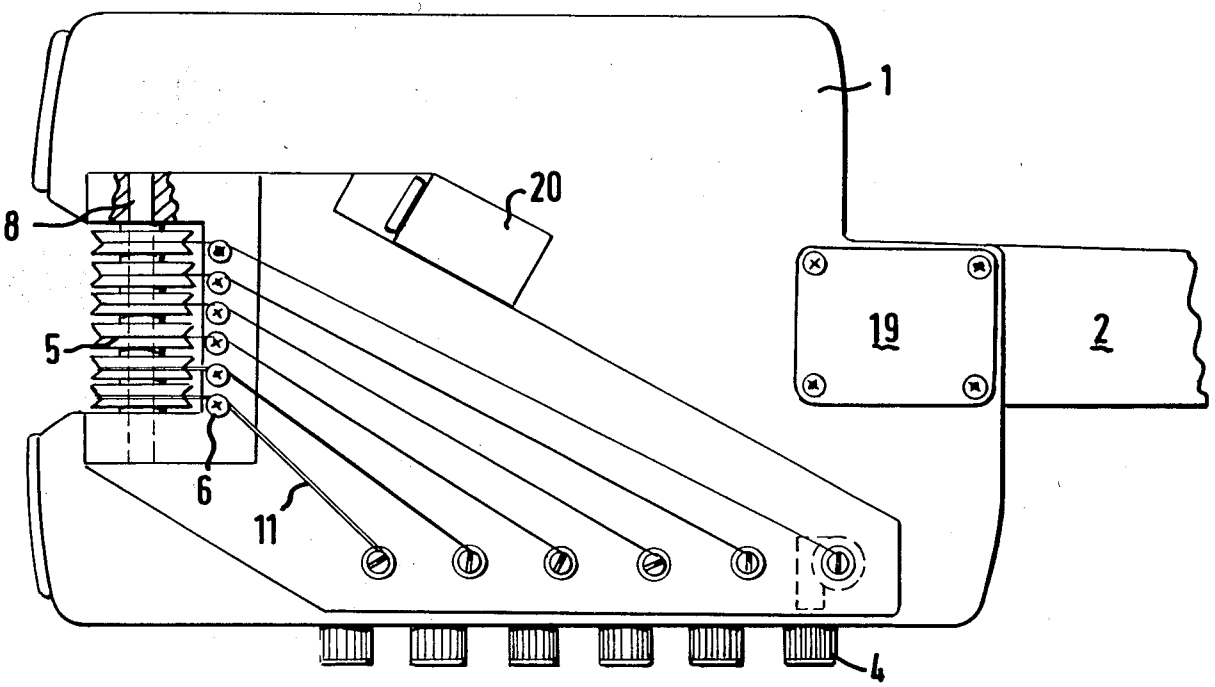
FIG. 1 is a rear view of the guitar with the neck omitted according to a first exemplary embodiment of the invention.
Figure 2A:
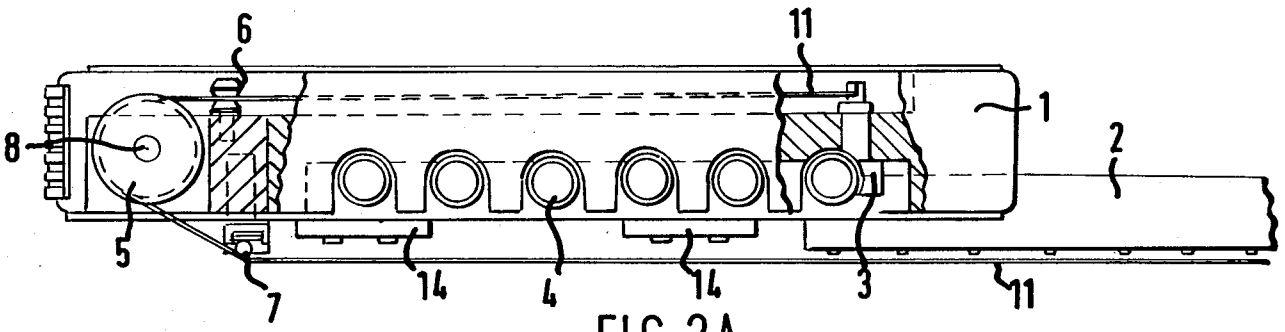
FIG. 2A is a side view, partly in section, of the part of the guitar shown in FIG. 1.
Figure 2B:
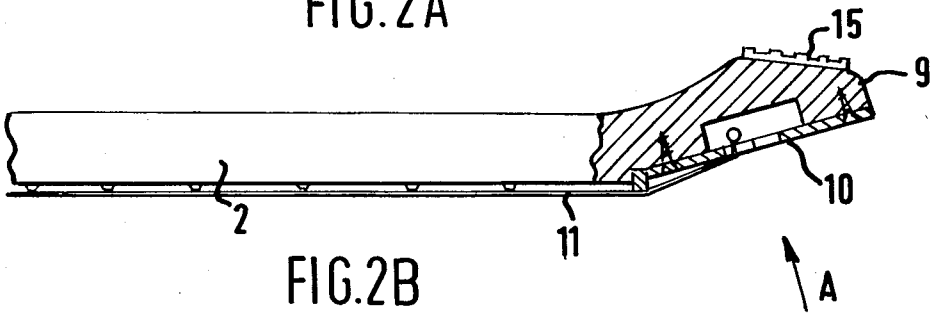
FIG. 2B is a side view of the neck of the guitar of FIGS. 1 and 2A.
Figure 2C:
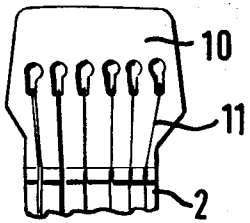
FIG. 2C is a fragmentary view taken in the direction of arrow A in FIG. 2B.
Figure 3:
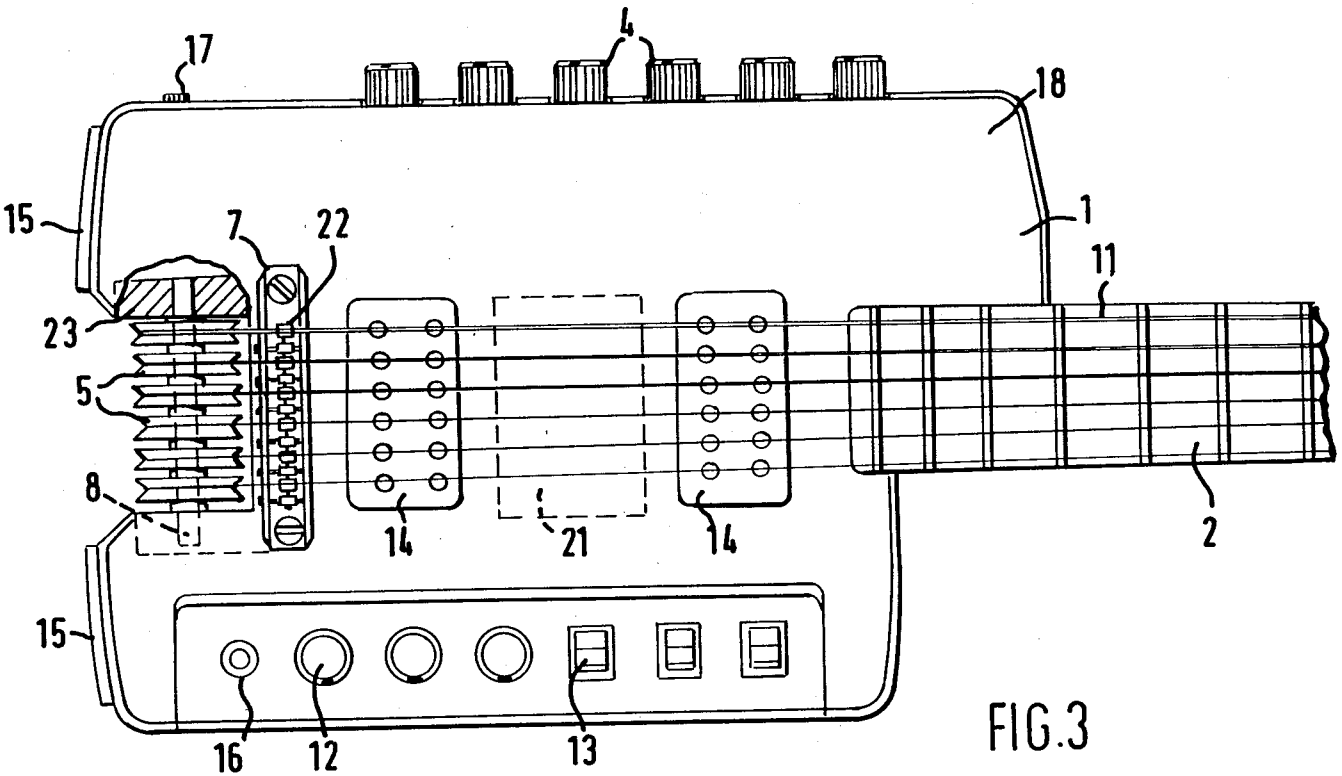
FIG. 3 is a front view of the (neckless) body of the guitar of FIGS. 1 and 2.

Referring first to FIGS. 1 to 3, a guitar according to a first embodiment of the invention has a body 1, a neck 2, a head 9 and six strings 11. Each string 11 is anchored in a string anchor plate 10 mounted in the head 9 and is capable of being tuned by rotation of a corresponding one of six, preferably knurled tuning knobs 4 projecting from one side edge of the body 1 and each coupled to a respective tuning machine 3 (only one of which is illustrated in broken lines) to which an associated string is attached. The tuning machines 3 are of known type, and although their location as embodied in the invention is unconventional, they operate in a known manner to adjust the tension of the strings 11 for tuning purposes.

The strings 11 pass over a roller bridge which is conventionally located on the front panel of the body 1 towards the base edge thereof, and comprises individual freely rotatable guide rollers or pulleys 22 for each string. From the bridge 7, the strings 11 are guided through 180° around freely rotatable guide pulleys 5 whence the strings pass across the rear of the body (visible in FIG. 1) to the tuning machines 3.

The pulleys 5 are coaxially supported on a common guide shaft 8 by means of plain or roller bearings (not shown) having polytetrafluoroethylene thrust washers (also not shown) therebetween to minimise friction. The guide shaft 8 spans a slot formed in the base edge of the body 1, the ends of the shaft 8 being mounted on an anchor block 23.

As can be seen from FIGS. 2 and 3, the rear of the body 1 is recessed to accommodate the portions of the strings 11 extending between the tuning machines 3 and the pulley 5. Since the strings 11 must leave the region of the pulleys 5, hereinafter called the main pulleys at different angles to reach the tuning machines 3, secondary guides or pulleys 6 are mounted adjacent the main pulleys 5, at the rear of the body 1.

The strings 11 diverge or fan out from the subsidiary pulleys 6 to the tuning machines 3.

On the front of the body 1 adjacent the other side edge (i.e. remote from the tuning machines 4) the guitar has a panel with an output jack socket 16 and control knobs 12 for volume, bass and treble and a pick-up selector and phase switches 13. Controls and a selector switch for a parametric equaliser may also be provided. A headphone jack socket 17 is provided on the side edge of the body adjacent the tuning machines 3, and the body 1 is also fitted with a board 21 carrying a pre-amplifier intended to serve a headphone for practice purposes. The guitar has conventional pick-ups 14 and neck anchorplate 19, together with a battery 20 for powering the pre-amplifier.

Figure 4:
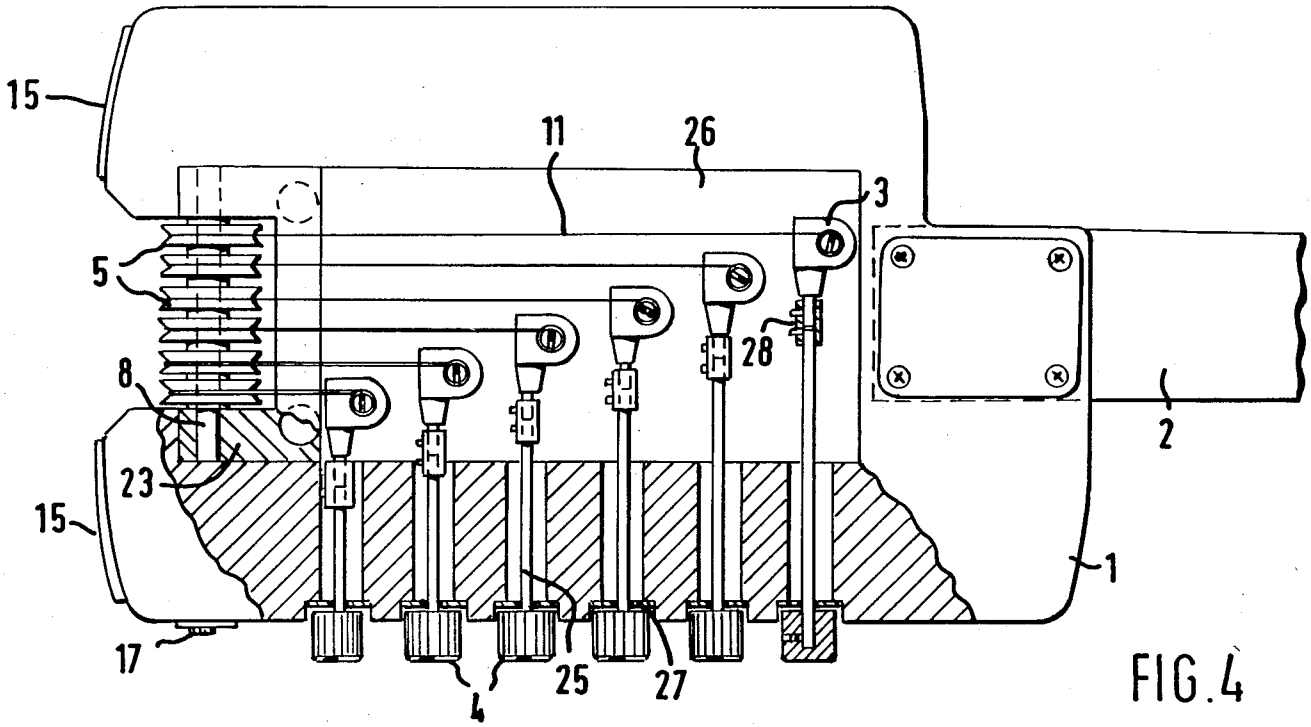
FIGS. 4, 5 and 6 are views respectively similar to those of FIGS. 1, 2A and 2B, and 3, but showing a second exemplary embodiment of the guitar, the neck being omitted and FIG. 6 being a partial view.
Figure 5:
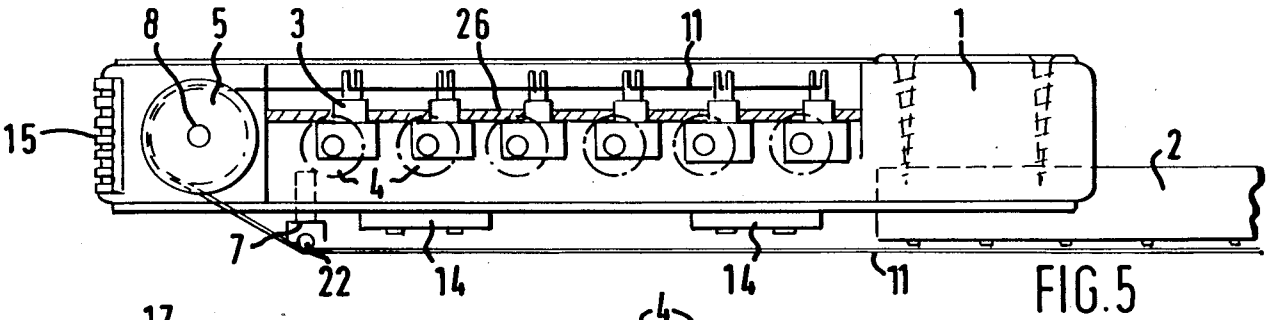
Figure 6:
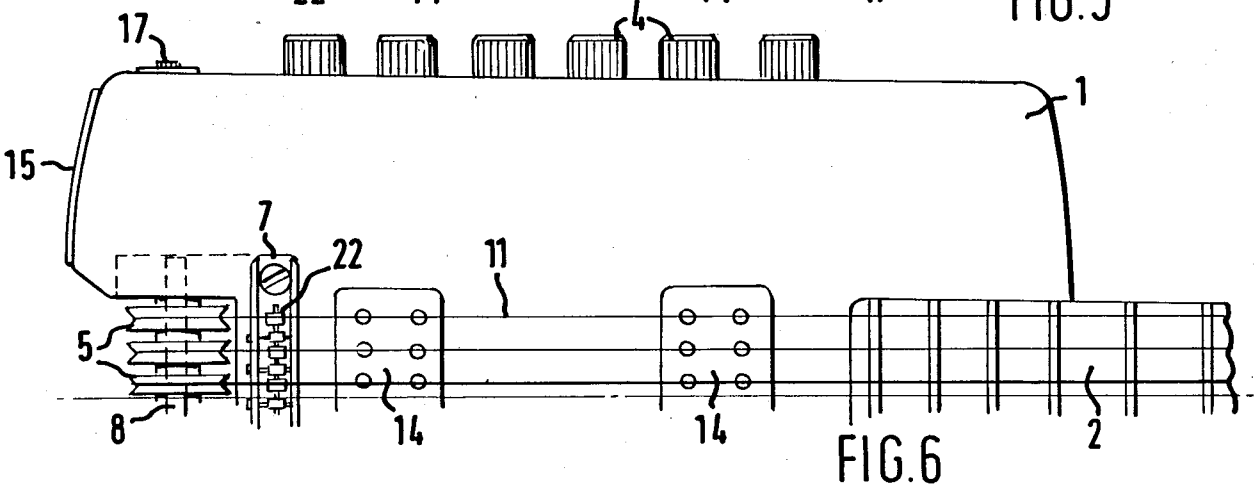

The second embodiment of guitar is similar to the first but the secondary pulleys 6 are dispensed with. The tuning machines 3 are mounted on a support panel 26 and are staggered across the width of the body 1, as well as being spaced lengthwise. The tuning knobs 6 are coupled to the machines 3 by means of collars 28 and spindles 25 of progressively greater length in a direction towards the neck 2. Thus the strings 11 leave the main pulleys 5 at the rear of the body in substantially parallel relationship, as shown in FIG. 4. Metal discs serve as bearings for the spindles 25. The tuning machines 3 are mounted on a metal mounting plate 26 and the rear of the body 1 has a recess which is rectangular in shape, as shown in FIG. 4, in contrast to the tapering recess in the body of the first embodiment. Compared with the first embodiment of the guitar, the second embodiment of FIGS. 4 to 6 has a slightly thicker body and the set of tuning knobs 4 are positioned slightly closer to the base edge of the body 1. The second embodiment allows the string path from the frets to the tuning machines 3 to be more direct than the first embodiment. The string path is via the bridge 7, bridge string guide rollers 22 and guide pulleys 5 which turn the string through 180° to take it directly onto the associated tuning machine 3.

Both embodiments of guitar are compact, being only about 31 inches long and 8 inches wide. Because of the positioning of the tuning machines 3 and their adjustment knobs 4, unison tuning is possible, there being no need to remove a finger from the fifth fret when tuning.

The right hand which is used to pluck the string in the tuning process, once the string has been plucked, can then be used to vary the tension of the string. The residual sound of the note played will only vary according to the tension of the string being tuned and not the whole length of the string being plucked because the fingers of the left hand can be re-positioned on the fret during the tuning process. The base edge of each guitar is provided with buffer pads 15 on respective sides of the slot, enabling the guitar to rest on the pads 15 in an upright stable position. The head 9 is also provided with a similar buffer pad 15. It will further be noted that the appearance of each guitar is individual and modernistic and is a departure from traditional designs of guitar, particularly in the straight side edges of the body.

The guitar preferably has a carrying case into which is built a practice amplifier more powerful than the pre-amplifier on the board 21. The case is generally rectangular to receive the guitar, the board 21 fitting into a recess at one end of the case. A hinged lid provides a sound reflecting board for the amplifier. A speaker is placed centrally into the body of the case and is externally protected by a grill.

We claim:

1. A guitar comprising a head (9), a body (1), means (10) for anchoring one end of each of a plurality of strings (11) to the head (9), and a plurality of tuning machines (3) mounted on the body (1) for retaining the non-anchored end of a string (11), characterised in that each tuning machine (3) is located on the back of the body (1) and that the arrangement of the guitar is such that, when strung, the strings pass from the front to the back of the body about the bottom edge thereof.

2. A guitar as claimed in claim 1, characterised in that guide means (5) are provided for guiding strings from the front to the back of the guitar body (1) about the bottom edge thereof.

3. A guitar as claimed in claim 2, wherein the guide means (5) comprises a number of freely-rotatable pulleys, one for each string.

4. A guitar as claimed in claim 2, wherein the guide means (5) is mounted in a slot formed in the bottom edge of the body.

5. A guitar as claimed in claim 2, characterised in that secondary guides (6) are provided for guiding the strings from the guide means (5) to the tuning machines (3).

6. A guitar as claimed in claim 1, characterised in that the tuning machines (3) are all spaced at the same distance from one side edge of the back of the guitar.

7. A guitar as claimed in claim 1, characterised in that the tuning machines (3) are so located on the back of the guitar that the strings (11) extend over the guitar back in a direction that is substantially parallel to their paths along the front of the guitar.

8. A guitar as claimed in claim 1, characterised in that the back of the guitar is recessed to accommodate the strings extending over the back of the guitar to the tuning machines.

9. A guitar as claimed in claim 1, wherein each tuning machine has associated with it an adjusting key or knob (4) by means of which the string attached to the tuning machine can be tuned, characterised in that the keys or knobs (4) are located along one side of the guitar body (1).

10. A guitar as claimed in claim 9, characterised in that the keys or knobs (4) are located along the top side of the guitar body (1) when the guitar is held in its playing position.

* * * * *